United States Patent [19]

Motomura

[11] 4,425,128

[45] Jan. 10, 1984

[54] AIR-PERMEABLE AND WATERPROOF DIAPER COVER

[75] Inventor: Kazuhiko Motomura, Fukuoka, Japan

[73] Assignee: Nishiki Co., Ltd., Fukuoda, Japan

[21] Appl. No.: 317,204

[22] Filed: Nov. 2, 1981

Related U.S. Application Data

[63] Continuation of Ser. No. 110,311, Jan. 8, 1980, abandoned.

[51] Int. Cl.[3] ..... A41B 13/02

[52] U.S. Cl. ..... 604/381; 604/384

[58] Field of Search ..... 128/284, 286, 287, 288, 128/290 R, 290 H; 604/367, 372, 378, 381, 382, 384, 385, 393, 394, 396

[56] References Cited

U.S. PATENT DOCUMENTS

| | | | |
|---|---|---|---|
| 2,555,434 | 6/1951 | Anderson | 128/288 |
| 2,566,046 | 8/1951 | Weinstein | 128/287 |
| 2,695,615 | 11/1954 | Del Guercio | 128/287 |
| 3,162,196 | 12/1964 | Salk | 128/287 |
| 3,237,625 | 3/1966 | Johnson | 128/288 |
| 3,424,162 | 1/1969 | Parravicini | 128/288 |
| 3,613,687 | 10/1971 | Kennedy | 128/288 |

FOREIGN PATENT DOCUMENTS

| | | | |
|---|---|---|---|
| 287003 | 2/1965 | Netherlands | 128/287 |

*Primary Examiner*—C. Fred Rosenbaum
*Assistant Examiner*—Sherri Vinyard
*Attorney, Agent, or Firm*—Jordan and Hamburg

[57] ABSTRACT

An air-permeable and waterproof diaper cover comprises a front body part and a rear body part and two wings attached to the left and right upper sides of the rear body part. The rear body part comprises at least a section of waterproof and stretching material, and the front body part comprises at least a section of air-permeable and water-repellent material, whereby the combination and location of such materials prevents leakage of liquid while permitting air and gas circulation.

27 Claims, 19 Drawing Figures

AIR-PERMEABLE AND WATERPROOF DIAPER COVER

This is a continuation, of application Ser. No. 110,311, filed Jan. 8, 1980 and now abandoned.

BACKGROUND OF THE INVENTION

This invention relates to air-permeable and waterproof diaper covers.

More particularly, this invention relates to a diaper cover for babies, infants and disabled adults.

In this invention, the term "waterproofing" means the property which prevents the penetration of water by coating and filling the gaps between warps and woofs together with the gaps between fibres of a knitted fabric and forming a continuous film on the knitted fabric. In such waterproof finish, the surface of the knitted fabric is covered to form a wall, and with the exception of a special condition the knitted fabric interrupts the passage of gases and liquids completely. Normally, the finished fabric resists a fair amount of water pressure, however, it has not provided resistance to wetting.

A water proofing and stretching material is a material finished by a synthetic resin as a waterproofing agent.

The term "water repellency" means the property which resists wetting by coating the fibres of a knitted fabric with a hydrophobic material or by directly combining hydrophobic groups to the fibre molecules. Finished clothes retain air permeability together with porosity, but depending on the construction of the clothes and the method of water repellent finishing, the resistance to water pressure changes.

For example, air permeable and stretching material is obtained by coating polyvinyl chloride resin on plain cloth of polyester 100%, 75 denier, 28 gauge, smooth knitting. By JIS L 1079-1976Chemical Fibre Fabric Testing Method, said material showed water pressure resistance exceeding 500 mm (a method based on low water pressure), while the air permeability was zero. But the film shows a good bonding property to plain cloth and has 20% lateral elongation. Thus, the characteristic stretching property of plain knitted cloth is preserved.

Because the polyvinyl chloride resin has some elastic property, even if the plain cloth is elongated, holes are not formed on the surface of the plain cloth thereby damaging the waterproofing property.

The term "air-permeable and water-repellent material" means a material, such as knitted fabric, which is made of synthetic fibres treated by an impregnation of synthetic resin such as of the fluorocarbon type, silicone type or the like to provide water repellency. The material is subjected to heat treatment to retain water-repellency. The treating temperature differs or varies depending on the kind of synthetic fibres. When the material is polyester fibres heat treatment is effected at approximately 170° C., and the result is material having a good feeling and retaining water repellency.

For example, air-permeable and water repellent material is obtained by impregnating a silicone resin liquid on plain cloth of polyester 100%, 100 denir, 24 gauge, smooth knitting, finished weight 260 g/m. This plain cloth is dipped in silicon resin liquid, the resin is deposited on the surfaces of the fibres of said cloth, dried and then finished. In relation to the term "smooth knitting", the two stages of smooth knitting means a doubled form of the rubber knitting by means of both sides of a circular knitting machine, and the three stages smooth knitting means a tripled form of the rubber knitting. By the above mentioned JIS L 1079-1976 Testing Method, said material showed water pressure resistance exceeding 160 mm (a method based on low water pressure method), water repellent degrees exceeding 70 (a method based on spraying method), and air permeable degrees exceeding 20 cc/cm$^2$/sec.

The term "air-permeable material" means a cloth, such as a normal knitted fabric, that is not treated for water-repellency or waterproofness. The material has little resistance to water pressure or to passing water therethrough, but provides sufficient air-permeability and stretching properties.

Principally, a diaper cover is required to have waterproofness and air-permeable properties, even though the two properties differs substantially in their functional properties and characteristics. A diaper cover which attaches importance to waterproof properties prevents leakage after urination, but because of the lack of permeability, the diaper cover is liable to become foul or stuffy in the interior thereof. On the other hand, a diaper cover which attaches importance to air-permeability provides for permeation of air and gases and relieves foulness and stuffiness in the interior of the diaper cover, but it is liable to leak urine through the openings used for air permeation.

Accordingly, there has been a need for many years for a diaper cover which has both air-permeability and waterproof properties.

SUMMARY OF THE INVENTION

Accordingly, it is an object of the present invention to provide a diaper cover which overcomes the disadvantages of known prior art diaper covers.

Another object of the present invention is to provide a air-permeable and waterproof diaper cover whereby leakage of liquid is prevented and the diaper cover is allowed to breathe.

This invention provides an air-permeable and waterproof diaper cover which comprises body parts including a front body part and a rear body part, two wings fitted to the left and right upper sides of the rear body part individually, two dams provided at two concave portions at both central sides of the body parts, a waist elastic, crotch elastics, fastening means such as snap fasteners, velvet fasteners or the like and is characterized in that the rear body part comprises at least a section of waterproof and stretching material, and the front body part comprises at least a section of air-permeable and water-repellent material.

BRIEF DESCRIPTION OF THE DRAWINGS

Preferred embodiments of the invention are shown in the accompanying drawings in which.

DESCRIPTION OF THE PREFERRED EMBODIMENTS

As regards to diaper cover styles, there are various styles: open styles, panty styles and new-born baby styles. Diaper covers of the open style will be described.

Figure 1:
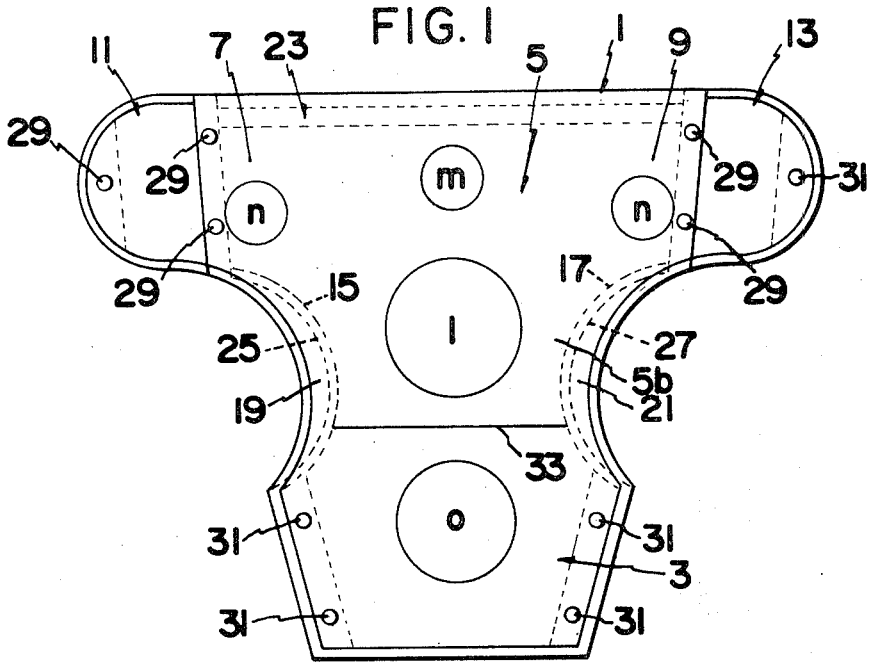
FIG. 1 is a diagrammatic developed view of a diaper cover to illustrate various functional parts thereof.

FIG. 1 shows a diaper cover having a body part 1 which consists of a front body part 3 and a rear body part 5. On both upper sides of the rear body 5 wings 11, 13 are fitted by means of bonding or seaming.

The general area represented by the circular portion 1 of the rear body part 5 is subjected to the most weight by the user and is wetted the most. Accordingly, the inner lining material of this portion 1 should provide complete waterproofing. Also, since this portion 1, especially in infants, is influenced by the motion of the body, it is advantageous if this portion of the diaper cover is provided with stretching properties.

The general area represented by the circular portion m is less subjected to the weight of the user than the circular portion 1, especially in infants. The frequency that it is subjected to the weight of the user is also significantly lower. This is because the portion m is subjected to the weight of the user only when the user's body lies facing upwardly and is wetted only when the entire diaper cover is wetted. The above examples do not apply, however, to heavy disabled persons who lie in bed continuously or to babies or infants who always lie face up.

The function of the rear body part 5 and front body part 3 which together constitute the body part 1 has been described, but the diaper cover provides some other elements which relate closely to the fundamental roles of the diaper cover. These members include dams 19, 21 and crotch elastics 25, 27 fitted together with the dams to provide concave portions 15, 17 of the body part 1. The concave portions are often subjected to wetting. The openings of the crotch portions are fastened by crotch elastics 25, 27. In addition to said crotch elastics there are doubly fitted dams 19, 21 which are formed by water proofed and stretching material; the edge or ridge portions of said dams are covered by the same type of elastic fibres as the crotch elastics 25, 27. The openings of the crotch portions are fastened by said dams respectively. In prior art diaper covers, these portions contain seam holes through which wetting is effected. Furthermore these portions require sufficient stretching properties.

The general areas shown as circular portions n are not subjected to the weight of the user as often as the circular portions l and m, and the chance of such portions becoming wet is reduced. Portions n are subjected to the user's weight only when the user lies on one side, and such portions are less subjected to wetting.

Accordingly, in consideration of the movement of the user, the general areas represented by the circular portion 1 and the circular portion m require a completely water-proof and stretchable material.

Next, with regard to the general area represented by the circular portion o positioned in the front body part 3, except when the user lies face down or the user is held, almost no weight is placed on such portion and also it is less wetted than the portions l, m and n.

In FIG. 1, numerals 7 and 9 represent the upper left and right sides of the rear body part 5 respectively. Numerals 15 and 17 represent concave portions or dam fitting portions provided on both sides of the body part 1. Numeral 23 represents a waist elastic and numerals 29 and 31 represent snap fastners.

However, the problem of wetting through the seam holes can be partially solved by the use of water-repellent sewing threads, and resolved completely by the application of bonding techniques such as high frequency bonding or the like.

Preferably, the bonded portion has tensile strength exceeding 2.5 kg/3 cm.

This invention provides an air-permeable and waterproof diaper cover utilizing at least a section of waterproof and stretching material for the rear body part 5, at least a section of air-permeable and water-repellent material for the front body part 3, and bonding of certain seams such as the seam 33 between the rear body part 5 and the front body part 3 and the crotch elastic portions 25, 27 which are equal to the fitting portions of the dams 19, 21 and the like.

In a preferred embodiment of the present invention, an air-permeable and waterproof diaper cover is characterized in that the rear body part consists of a piece of waterproof and stretching material, and the front body part consists of a piece of the air-permeable and water-repellent material.

Figure 2:
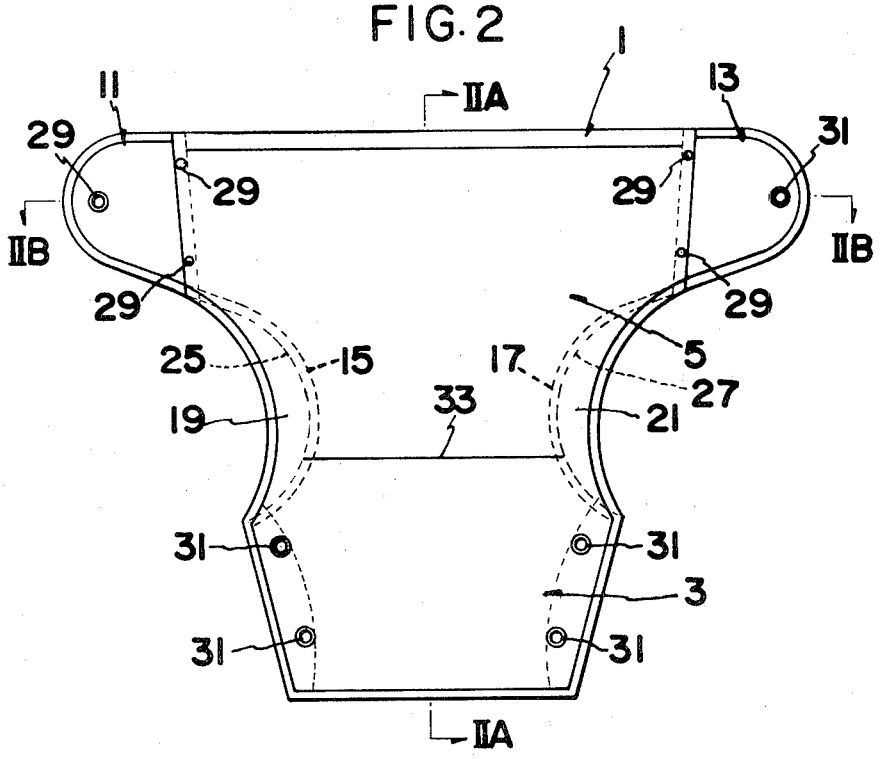
FIG. 2 is a diagramatic developed view of an air-permeable and waterproof diaper cover according to the invention.
Figure 3:
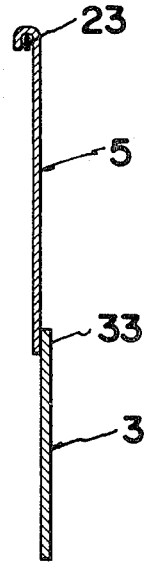
FIG. 3 is a sectional view taken along line IIA—IIA of FIG. 2.
Figure 4:
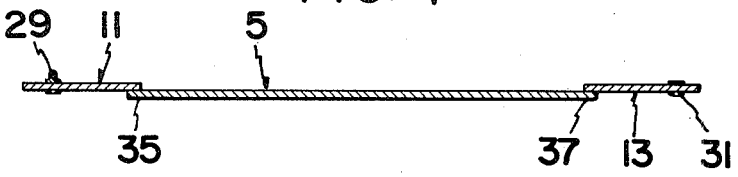
FIG. 4 is a sectional view taken along line IIB—IIB of FIG. 2.

FIGS. 2 to 4 show a diaper cover according to one embodiment of this invention, which is in accordance with the requisites of the above mentioned diaper cover and which has a simple construction. In this embodiment the rear body part 5 is formed from a piece of waterproof and stretching material, and the front body part 3 is formed from a piece of the air-permeable and water-repellent material.

In all embodiments of the invention, wings 11, 13 are fitted to the left and right upper sides 7, 9 individually by means of sewing or bonding.

Because the rear body part 5 and the front body part 3 are connected by a bonding means such as high frequency bonding, leakage of urine through the overlapping portions of the bonded seam is prevented.

Because the dams 19, 21 are formed either by an air-permeable and water-repellent material or by a waterproof and stretching material, such material is bonded to the edges of the concave portions 15, 17 at the central and both sides of the body part 1 by similar means as described above, and leakage of urine from the dam fitting portions is thereby prevented.

In another preferred embodiment of the present invention, the inner lining of the rear body part consists of a piece of waterproof and stretching material, the outside of the rear body part consists of a section of air-permeable, and water-repellent material or air-permeable material. The front body part also consists of a section of air-permeable and water-repellent material, and the outer surface material of the rear body part and the front body part are made from one piece of cloth material.

Figure 5:
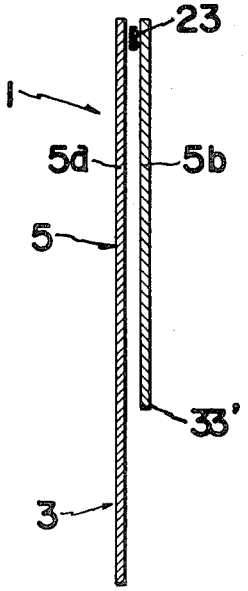
FIG. 5 is a sectional view showing another embodiment.

FIG. 5 shows the above described embodiment in which the front body part 3 is formed by one piece which is of an air-permeable and water-repellent material and forms a seamless continuation of the outer surface 5*a* of the rear body part 5. The inner lining rear body part 5*b* is formed by a waterproof and stretching material. The rear body part 5*b* is terminated at the lower edge 33' and said rear body part is bonded to said outer surface at said lower edge.

In a further embodiment of the present invention, an air-permeable and waterproof diaper cover is characterized in that the inner lining of the rear body part consists of a piece of waterproof and stretching material, the outer side of the rear body part consists of a piece of air-permeable and water-repellent material or a piece of air-permeable material. The inner lining of the front body part consists of a piece of air-permeable and water-repellent material, the outer surface of the front body part consists of a piece of air-permeable and water-repellent material or air-permeable material, and the outer surface material of the rear body part and the outer surface material of the front body part are made from one piece of such material.

Figure 7:
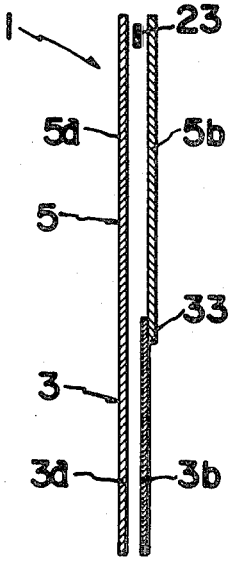
FIG. 7 is a sectional view taken along line VIA—VIA of FIG. 6.
Figure 6:
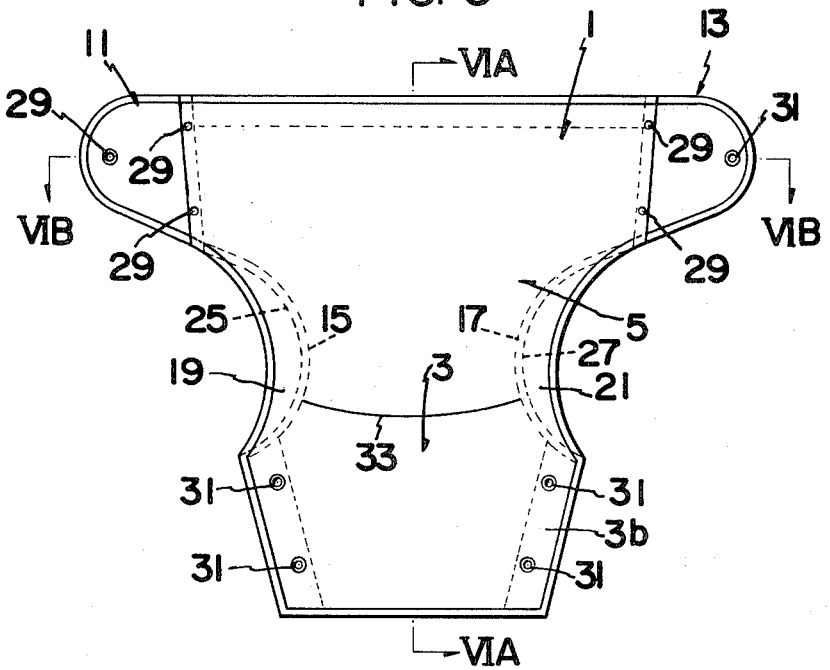
FIG.6 is a diagrammatic developed view of an air-permeable and waterproof diaper cover according to another embodiment of the present invention.
Figure 8:
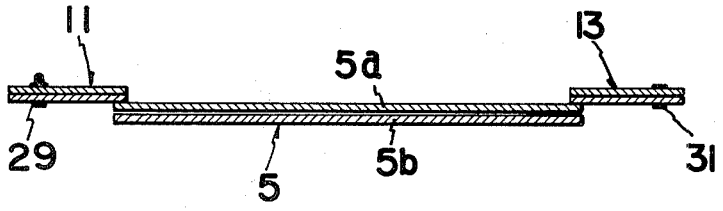
FIG. 8 is a sectional view taken along line VIB—VIB of FIG. 6.

FIGS. 6 to 8 show the above embodiment according to the invention. The outer surface material 3*a*, 5*a* are formed as one piece from an air-permeable and water-repellent material or air-permeable material and the lining material of the front body part and rear body part 3*b*, 5*b* are formed by an air-permeable and water-repellent material and by a water-proof and stretching material respectively, the two materials being bonded together at an overlapped edge portion or seam 33 having a curved configuration.

However, as shown in other alternate embodiments, the overlapped bonded edge portion 33 may form a straight line.

As indicated above, when one piece of air-permeable and water-repellent material or of air-permeable material is used for the outside surface of body parts 3*a* and 5*a*, the inner lining parts 3*b* and 5*b* are protected by such outer material.

In a further embodiment of the present invention, an air-permeable and waterproof diaper cover is characterized in that the inner lining of the rear body part consists of a piece of air-permeable and water-repellent material, an intermediate material of the rear body part consists of a piece of waterproof and stretching material, and an outer surface material of the rear body part consists of air-permeable and water-repellent material or of air-permeable material. The lining of the front body part consists of air-permeable and water-repellent material, the outer surface of the front body part consists of a piece of air-permeable and water-repellent material or of air-permeable material, and the outer surface of the rear body part and the outer surface of the front body part are each made from a single piece of material.

Figure 9:
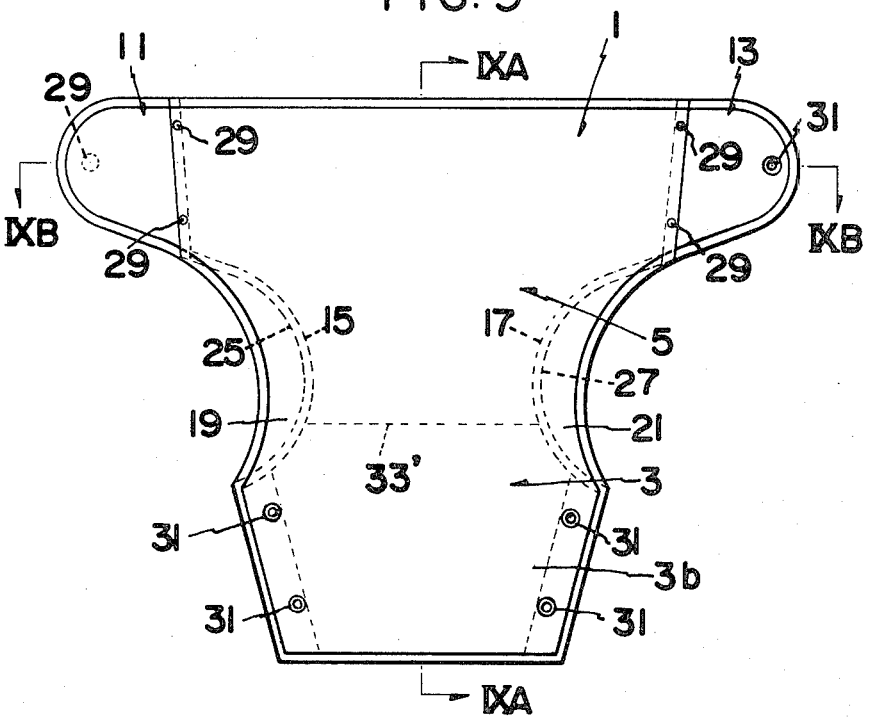
FIG. 9 is a diagramatic developed view of an air-permeable and waterproof diaper cover according to a further embodiment of the present invention.
Figure 11:
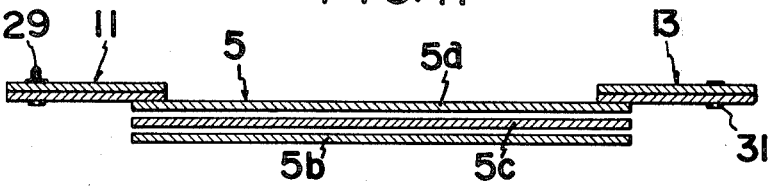
FIG. 11 is a sectional view taken along line IX-B—IXB of FIG. 9.
Figure 10:
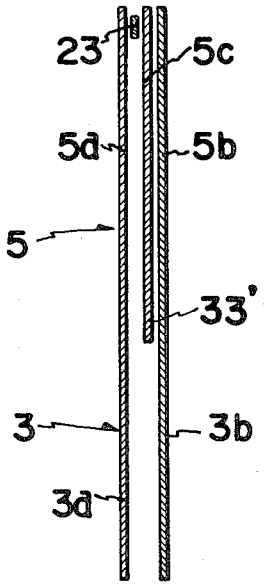
FIG. 10 is a sectional view taken along line IX-A—IXA of FIG. 9.

FIGS. 9 to 11 show the above embodiment of the diaper cover according to the invention, FIG. 10 particularly shows two pieces of an air-permeable and water-repellent material (or alternatively one piece of air-permeable material) being used. This one piece of air-permeable and water-repellent material continuously forms the outer front body part 3*a* and the outer rear body part 5*a*. Another piece forms the lining surfaces 3*b* and 5*b*. A waterproof and stretching material is sandwiched as the intermediate material 5*c* between the rear body parts 5*a* and 5*b*.

In the use of the above diaper cover, urine permeates the lining material of the rear body part 5*b*, but it does not penetrate the outer surface material of the rear body part 5*a* because of the intermediate waterproof and stretching material 5*c*.

The diaper cover, as indicated above, has long durability because the waperproof and stretching material used as the intermediate material 5*c* is protected by the air-permeable and water-repellent materials or the air-permeable material used therewith.

In the embodiment of FIGS. 2 to 11, the four kinds of diaper covers disclosed therein are based on the combinations of the air-permeable material, the air-permeable and water-repellent material, and the waterproof and stretching material. These combinations provide a air-permeable and waterproof diaper cover by utilizing the advantages characteristic of each such material.

In other preferred embodiments of the present invention, the air-permeable and waterproof diaper cover is characterized in that the two dams consist of the air-permeable and water-repellent materials or waterproof and stretching material, such materials being bonded to the edges of the concave portions at the central part of both sides of the body parts respectively, and elastic or rubber marginal portions at the crotch edge portions of the dams consist of stretching materials having air permeability and water-repellency.

In the embodiments of FIGS. 1, 6, 9, 12, 15 and 18 dams 19, 21 consist of the air-permeable and water-repellent material or the waterproof and stretching material. such materials being bonded to edges of the concave portions 15, 17 at both central sides of the body part. The elastic portions of the crotch elastic 25, 27 and the edge portions of the dams consist of elastic material having air-permeability and water-repellency.

Because, the amount of urine from a baby is small while that of a disabled adult is large and the amount differs in day time and night individually, the materials for dams 19, 21 are selected from either the air-permeable and water-repellent material or the waterproof and stretching material depending on its use.

In one preferred embodiment of the present invention, the air-permeable and waterproof diaper is characterized in that the air-permeable and water-repellent material forming the front body part is bonded to the waterproof and stretching material forming the rear body part at an overlapping section.

The bonding of the air-permeable and water-repellent material forming the front body part 3 and the waterproof and stretching material forming the rear body part 5 is effected by a method such as high frequency bonding to improve waterproofness.

In another preferred embodiment of the present invention, the air-permeable and waterproof diaper cover is characterized in that both upper sides of the rear body part to which two wings are fitted consist of at least two pieces of air-permeable and water-repellent material, or two pieces of air-permeable and water-repellent material and two pieces of air-permeable material.

Figure 12:
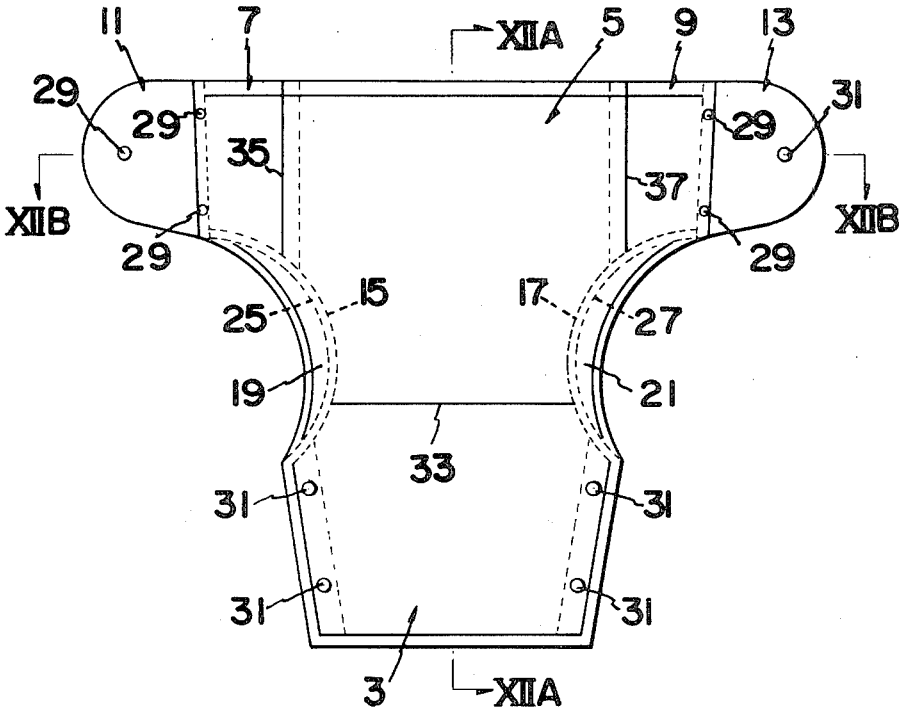
FIG. 12 is a diagramatic developed view of a diaper cover according to yet another embodiment of the present invention.

FIG. 12 shows a further alternate embodiment of a different type of a diaper cover according to the invention in which constant portions at the upper left side and upper right side of the rear body part 5, that is the portions which are connected to wings 11, 13 respectively are cut away, and instead two pieces of the air-permeable and water-repellent material are attached, and if desired, bonded with the neighborring portions.

Figure 13:
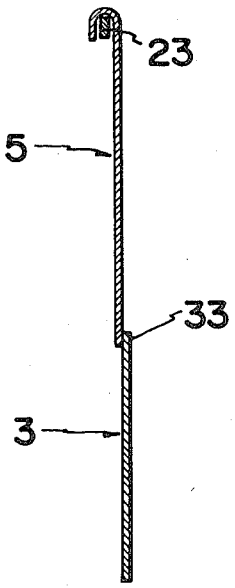
FIG. 13 is a sectional view taken along line XIIA—XIIA of FIG. 12.
Figure 14:
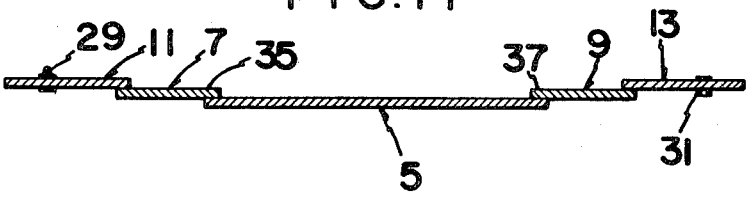
FIG. 14 is a sectional view taken along line XIIB—X-IIB of FIG. 12.

The diaper cover shown in FIGS. 12 to 14 is a modification of that shown in FIG. 2, and in the embodiment of FIGS. 12 to 14, both upper side sections 7, 9 of the rear body part 5 are formed by a piece of air-permeable and water-repellent material.

As seen in the drawings, since the rear body part 5, both upper sides of the rear body part 7, 9 and the front body part 3 all have a configuration similar to a rectangle or trapezoid, the diaper cover has less waste material based on cut pieces of blank material.

Figure 15:
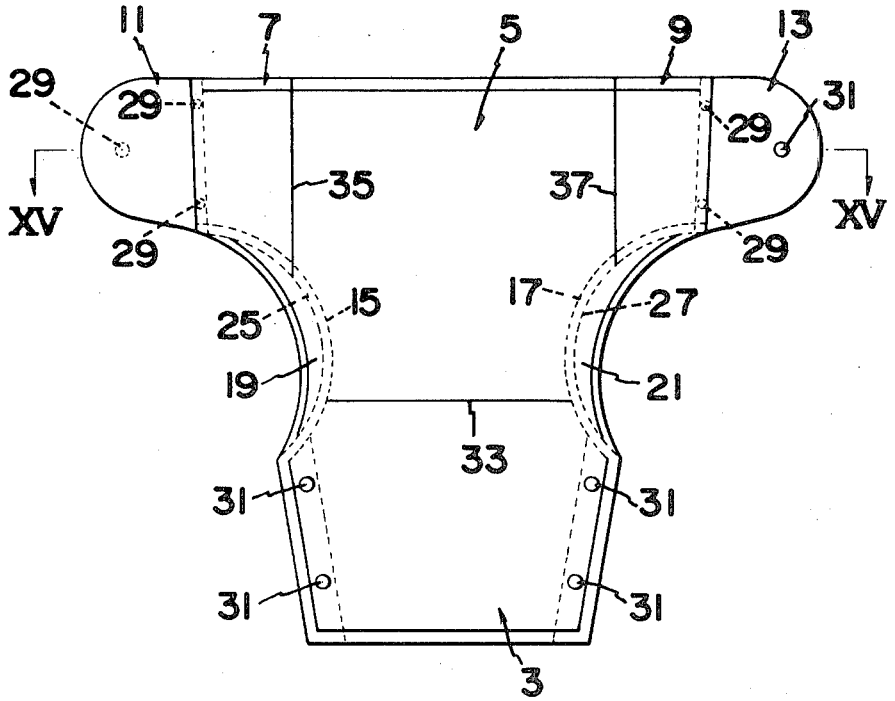
FIG. 15 is a diagramatic developed view of an air-permeable and waterproof diaper cover according to yet a further embodiment of the present inventions.
Figure 16:
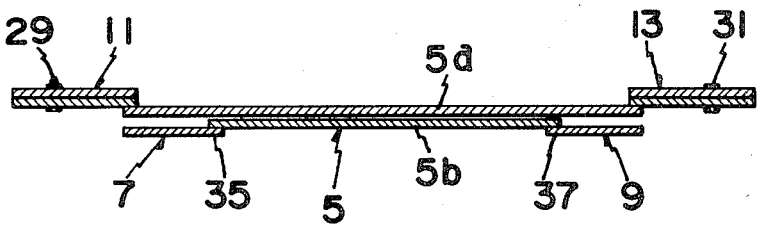
FIG. 16 is a sectional view taken along line XV—XV of FIG. 15.

The diaper cover shown in FIGS. 15 and 16 is a modified version of the diaper cover shown in FIGS. 5 and 7. In the embodiment of FIGS. 15 and 16, both upper sides 7, 9 of the rear body part 5 are formed by pieces of the air-permeable and water repellent material or pieces of the air-permeable and water-repellent material and a piece of the air-permeable material, which contains at least a small rectangular piece of such material, respectively. Both sides 7, 9 are bonded to the inner lining material of the rear body part **5*b* formed by the waterproof and stretching material at bonding seams 35 and 37**.

Figure 17:
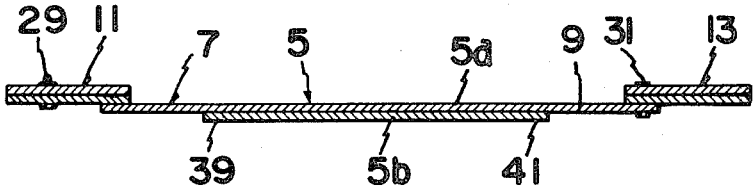
FIG. 17 is a sectional view of an air-permeable and water-proof diaper cover according to another embodiment of the present invention.

In a further alternate embodiment shown in FIG. 17, the lining material of both upper sides 7, 9 is eliminated from the diaper cover as compared to the embodiment of FIGS. 15 and 16. In the FIG. 17 embodiment, a lining material for the rear body part **5*b* is formed by the waterproof and stretching material which is bonded to the outer surface material of the rear body part 5*a* formed by the air-permeable and water-repellent material at both side edges 39, 41 of the lining material 5*b***.

Figure 18:
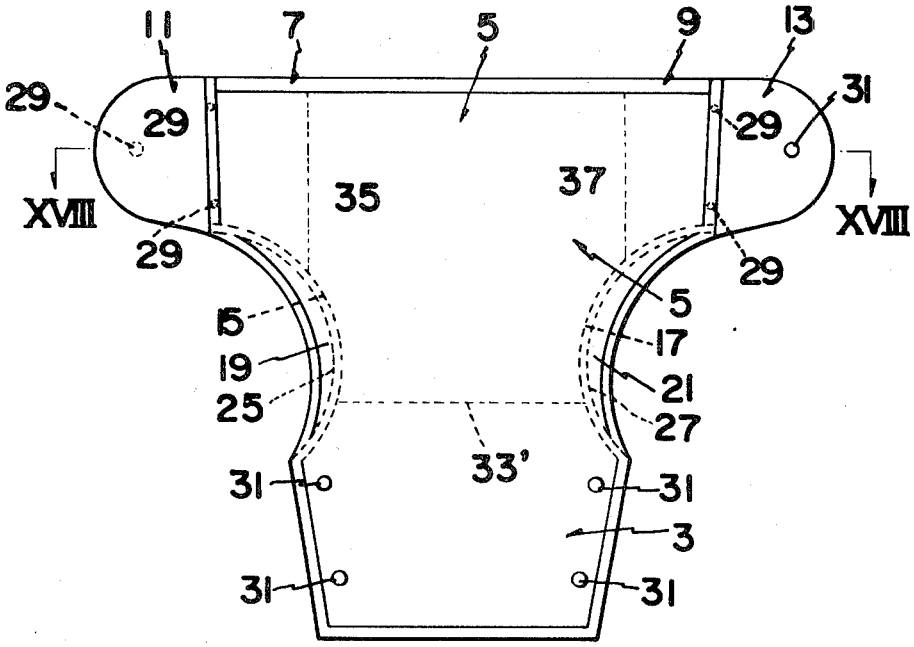
FIG. 18 is a diagramatic developed view of an air-permeable and waterproof diaper cover of a further embodiment according to the invention.
Figure 19:
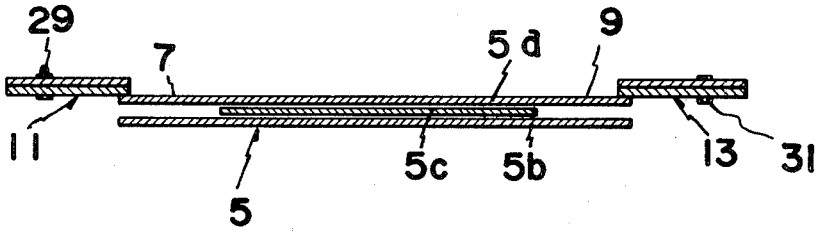
FIG. 19 is a sectional view taken along line XVIII—XVIII of FIG. 18.

FIGS. 18 and 19 show a further alternate diaper cover which is a modified version of that shown in FIGS. 9 to 11. In the embodiment of FIGS. 18 and 19, an intermediate material **5*c* is formed by a waterproof and stretching material which has a rectangular shape. Cutting of the material is simple and little waste material is produced. The neighboring portions to both upper sides 7, 9 of the intermediate material 5*c* at the rear body part have free ends which do not require bonding as is not required at the lower end of the intermediate cloth 5*c***.

Also, edge portions of the outer surface and the inner lining are bonded to each other by means of piping or overlocking.

The above three different embodiments of diaper covers are suitable for use in the day time since the skin of the user's body is activated and liable to be stuffy.

As mentioned above, each type of diaper cover according to the invention may be produced by utilizing the special functional characteristics of each portion required in a diaper cover selecting materials suited to such portions, and then combining them.

In accordance with the present invention the following advantages are obtained.

(1) The combination of the materials required for each portion of the diaper cover allows the diaper cover to provide sufficient air-permeability and waterproofness but does not permit leakage of urine.

(2) The diaper cover provides sufficient air-permeability and stretching properties and is comfortable for the user.

(3) The diaper cover is designed to avoid waste, with the cutting loss reduced significantly due to the blocking of the body parts which become miniaturized. For example, portion o and portion l in FIG. 1 are separated, or portions n, portion l and portion o are separated relative to each other and concave portions and convex portions around each cut piece are less. Such diaper cover is produced inexpensively making use of relatively small amounts of materials and by simple manufacturing procedures.

What is claimed is:

1. An air-permeable and waterproof diaper cover comprising a front body part and a rear body part, and two wings attached to one of said body parts, said rear body part comprising at least a section of waterproof and stretching material, said front body part comprising at least a section of air-permeable and water-repellent material, said waterproof and stretching material comprising a knitted fabric coated with a synthetic resin continuous film as a waterproofing agent, said synthetic resin continuous film having elastic properties such that said waterproof and stretching material can be elongated when used as a diaper cover without holes being formed and waterproofing is thereby retained.

2. An air-permeable and waterproof diaper cover according to claim 1 characterized in that said rear body part is made from a piece of waterproof and easy to stretch material, and said front body part is made from a piece of air-permeable and water-repellent material.

3. An air-permeable and waterproof diaper cover according to claim 1 characterized in that said rear body part comprises an inner lining of waterproof and easy to stretch material, and an outer face of said outer face of said rear body part and said front body part comprising a single piece of said air-permeable and water-repellent material.

4. An air-permeable and waterproof diaper cover according to claim 1 characterized in that said rear body part comprises an inner lining of waterproof and easy to stretch material and an outer face of air-permeable material, said front body comprising an outer surface face of air-permeable material, said outer surface face of said rear body part and said outer surface face of said front body part comprising a single piece of said air-permeable and water-repellent material.

5. An air-permeable and waterproof diaper cover according to claim 1 characterized in that said rear body part comprises a lining of said air-permeable and water-repellent material, an intermediate piece of waterproof and easy to stretch material, and an outer surface face of air-permeable material, said front body part comprising a lining of air-permeable and water-repellent material and an outer surface face of air-permeable material, said outer surface face of said rear body part and said outer surface face of said front body part comprising a single piece of said air-permeable and water repellent material.

6. An air-permeable and waterproof diaper cover according to claim 1 characterized in that said front and rear body parts have concave portions generally centrally at both side edges, and dams provided at said concave portions.

7. An air-permeable and waterproof diaper cover according to claim 6 characterized by waist elastic portions and crotch elastic portions on said body parts.

8. An air-permeable and waterproof diaper cover according to claim 7 characterized in that said two dams each comprise air-permeable and water-repellent material, said dam materials being bonded to the edges of said concave portions of said body parts respectively, said crotch elastic portions and edge portions of said dams comprising stretching materials having gas-permeability and water-repellency.

9. An air-permeable and waterproof diaper cover according to claim 1 characterized in that said front body part is bonded to said rear body part along an overlapping seam.

10. An air-permeable and waterproof diaper cover according to claim 1 characterized in that both upper sides of the rear body part to which said two wings are fitted comprises at least two pieces of the air-permeable and water repellent material, and two pieces of the air-permeable materials.

11. An air-permeable and waterproof diaper cover according to claim 1 characterized by fastener means on said two wings and on said front body part.

12. An air-permeable and waterproof diaper cover according to claim 1, characterized in that said rear body part comprises a main section and two extending sections joined to said main section, said two wings being attached to said two extending sections.

13. An air-permeable and waterproof diaper cover according to claim 12 characterized in that said main section and said two extending sections have a generally rectangular configuration.

14. An air-permeable and waterproof diaper cover according to claim 12 characterized in that said main section and said two extending sections have a generally trapezoidal configuration.

15. A diaper cover according to claim 1, wherein said knitted fabric is polyester.

16. A diaper cover according to claim 1, wherein said knitted fabric is 100% polyester.

17. A diaper cover according to claim 1, wherein said knitted fabric is 100% polyester, 75 denir, 28 gauge.

18. A diaper cover according to claim 1, wherein said resin is bonded to said knitted fabric.

19. An air-permeable and waterproof diaper cover comprising a front body part and a rear body part, said rear body part having two wings extending to the left and right upper sides of the rear body part, said rear body part comprising at least a section of waterproof and stretching material, said waterproof and stretching material comprising a knitted synthetic fabric coated with a first synthetic resin continuous film as a waterproofing agent, said first synthetic resin continuous film having elastic properties such that said waterproof and stretching material can be elongated when used as a diaper cover without holes being formed and waterproofing is thereby retained, said front body part comprising at least a section of air-permeable and water-repellent material, said air-permeable and water-repellent material comprising a knitted fabric of synthetic fibers impregnated with a second synthetic resin, and seam means between said rear body part and said front body part, whereby air-permeability is provided at the front of the diaper cover and waterproofing is provided at the rear of the diaper cover such that both characteristics of air-permeability and waterproofing are obtained in the diaper cover.

20. An air-permeable and waterproof diaper cover comprising a front body part and a rear body part, and two wings attached to one of said body parts, said rear body part comprising at least a section of waterproof and stretching material, said front body part comprising at least a secton of air-permeable and water-repellent material, said waterproof and stretching material comprising a knitted synthetic fabric coated with a first synthetic resin continuous film as a waterproofing agent, said first synthetic resin continuous film having elastic properties such that said water-proof and stretching material can be elongated when used as a diaper cover without holes being formed and waterproofing is thereby retained, said air-permeable and water-repellent material comprising a knitted fabric of synthetic fibers impregnated with a second synthetic resin.

21. A diaper cover according to claim 20, wherein said second synthetic resin comprises a fluorocarbon resin.

22. A diaper cover according to claim 20, wherein said second synthetic resin comprises a silicone resin.

23. A diaper cover according to claim 20, wherein said air-permeable and water-repellent material is constructed to retain water-repellency.

24. A diaper cover according to claim 20, wherein said knitted fabric of said air-permeable and water-repellent material comprises polyester.

25. A diaper cover according to claim 20, wherein said knitted fabric of said air-permeable and water-repellent material comprises 100% polyester, 100 denir, 24 gauge, with a finished weight of 260 g/m.

26. An air-permeable and waterproof diaper cover comprising a front body part and a rear body part, and two wings attached to one of said body parts, said rear body part comprising at least a section of waterproof and stretching material, said front body part comprising a least a section of air-permeable and water-repellent material, said waterproof and stretching material comprising a knitted synthetic fabric coated with a first synthetic resin continuous film as a waterproofing agent, said first synthetic resin continuous film having elastic properties such that wais waterproof and stretching material can be elongated when used as a diaper cover without holes being formed and waterproofing is thereby retained, said waterproof and stretching material being constructed to provide 20% elongation, said air-permeable and water-repellent material comprising a knitted fabric of synthetic fibers impregnated with a second synthetic resin.

27. A diaper cover according to claim 7, wherein said two dams each comprise waterproof and stretching material, said dam materials being bonded to the edges of said concave portions of said body parts respectively, said crotch elastic portitons and edge portions of said dams comprising stretching materials having gas-permeability and water-repellency.

* * * * *